US009017029B2

(12) United States Patent
Pichel

(10) Patent No.: US 9,017,029 B2
(45) Date of Patent: Apr. 28, 2015

(54) GAS-TURBINE BALANCING DEVICE

(75) Inventor: Sacha Pichel, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 367 days.

(21) Appl. No.: 13/463,919

(22) Filed: May 4, 2012

(65) Prior Publication Data

US 2012/0282082 A1 Nov. 8, 2012

(30) Foreign Application Priority Data

May 6, 2011 (DE) ..... 10 2011 100 783

(51) Int. Cl.
*F01D 5/10* (2006.01)
*F01D 9/06* (2006.01)
*F01D 5/02* (2006.01)

(52) U.S. Cl.
CPC ..... *F01D 9/065* (2013.01); *F01D 5/027* (2013.01)

(58) Field of Classification Search
CPC ..... F01D 9/065; F01D 5/027
USPC ..... 416/144
See application file for complete search history.

(56) References Cited

U.S. PATENT DOCUMENTS

| | | | | |
|---|---|---|---|---|
| 3,736,811 | A * | 6/1973 | Neary | 464/180 |
| 3,985,465 | A | 10/1976 | Sheldon et al. | |
| 4,064,762 | A | 12/1977 | Wikner | |
| 4,803,893 | A | 2/1989 | Bachinski | |
| 4,856,964 | A | 8/1989 | Stock | |
| 4,898,514 | A | 2/1990 | McCracken | |
| 5,545,010 | A | 8/1996 | Cederwall et al. | |
| 6,279,420 | B1 | 8/2001 | Knorowski et al. | |
| 2005/0265846 | A1* | 12/2005 | Przytulski et al. | 416/144 |
| 2006/0266114 | A1 | 11/2006 | Pichel et al. | |
| 2010/0316496 | A1* | 12/2010 | Williams et al. | 416/144 |

FOREIGN PATENT DOCUMENTS

| | | |
|---|---|---|
| DE | 2627702 | 1/1977 |
| DE | 102005025086 | 11/2006 |
| EP | 1602855 | 12/2005 |
| EP | 726780 | 11/2006 |
| EP | 2397651 | 12/2011 |
| FR | 2630496 | 10/1989 |
| JP | 55072937 | 6/1980 |

OTHER PUBLICATIONS

European Search Report dated Jul. 25, 2012 for counterpart European patent application.
German Search Report dated Apr. 10, 2012 from counterpart German patent application.

* cited by examiner

*Primary Examiner* — Liam McDowell
(74) *Attorney, Agent, or Firm* — Timothy J. Klima; Shuttleworth & Ingersoll, PLC

(57) ABSTRACT

The present invention relates to a gas-turbine balancing device with at least one annular groove provided on the outer circumference of at least one intermediate or high-pressure rotor of an intermediate or high-pressure compressor, with at least one balancing element being arranged in the annular groove, and with the balancing element being moveable in the circumferential direction along the annular groove and provided with a fixing device.

7 Claims, 3 Drawing Sheets

GAS-TURBINE BALANCING DEVICE

Figure 1:
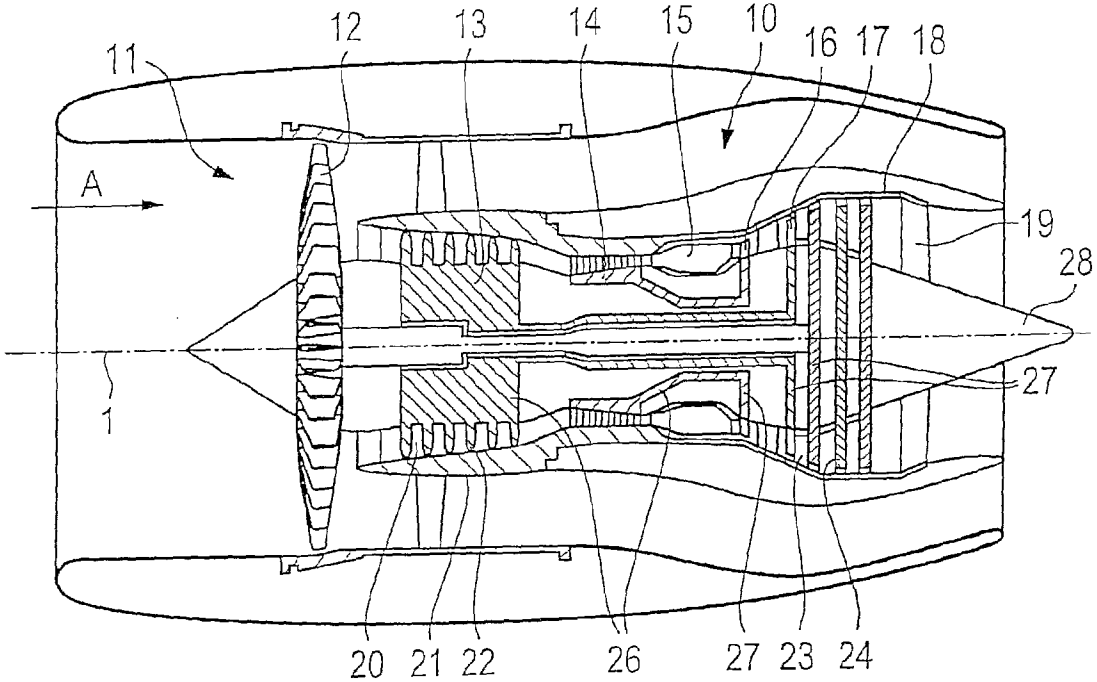

This application claims priority to German Patent Application

DE102011100783.4 filed May 6, 2011, the entirety of which is incorporated by reference herein.

This invention relates to a balancing device, in particular to a gas-turbine balancing device which can be used for balancing of the intermediate or high-pressure shaft in the assembled state of the gas turbine.

At present, balancing of the high-pressure and low-pressure shafts is performed in various steps. First the individual rotor drums are balanced. To do so, material is generally removed from previously determined points on the drum. This is followed by balancing of the assembled individual drums. After assembly of the complete engine, minor corrections are then performed on the low-pressure shaft, for example by attaching weights to the freely accessible blower (fan). This is not readily possible at the high-pressure shaft due to lack of accessibility.

The residual imbalance in the high-pressure shaft and other causes can lead to vibrations and to the rejection of the engine. A method for trim balancing of the high-pressure shaft in the assembled engine would avoid this disadvantage, since vibrations occurring can thus be countered by applying a selected counter-imbalance.

U.S. Pat. No. 5,545,010 A describes a method where weights are installed in or removed from an additionally attached ring. The accessibility is achieved via the gas flow path.

U.S. Pat. No. 4,898,514 A describes a method in which the balance masses are fitted in axial blade root grooves. This requires a specific blade standard with reduced blade root length. The accessibility is not described here in detail.

U.S. Pat. No. 4,803,893 A describes a method in which an additional recess is provided in the disk contour of a turbine disk and inside which special balance weights can be fitted. Here too the accessibility is not described in detail.

The solution in accordance with U.S. Pat. No. 5,545,010 A uses an additional ring in which weights are installed and removed. This ring is an additional component with a relatively high weight. Furthermore, the accessibility via the annular space is only possible at the first rotor stage in a modern axial compressor. This method cannot be used for the high-pressure shaft.

The solution in accordance with U.S. Pat. No. 4,898,514 A is not feasible in practice, since very high stresses would occur in the blade root.

All known methods are only applicable to turbine or possibly front compressor stages. Satisfactory accessibility in the assembled state of a modern axial compressor is possible only to a limited extent, if at all. Balance weights can only be attached to the front or rear end of the high-pressure rotor near to the bearing and to a sometimes small diameter. This is not very effective from the rotor dynamics viewpoint and requires appropriately massive weights. Also, all the methods described require special additional parts and considerable adaptations to the surrounding components. This entails a correspondingly high weight and additional costs.

In a broad aspect, the present invention provides a gas-turbine balancing device, which while being simply designed and easily and dependably operable, guarantees a high degree of efficiency.

It is thus provided in accordance with the invention that at least one annular groove is provided that extends in a radial plane relative to an engine axis. At least one balancing element is arranged in this at least one annular groove, which is provided on the outer circumference of at least one high-pressure rotor of a high-pressure compressor. The balancing element(s) is (are) in accordance with the invention moveable in the circumferential direction along the annular groove and can be fixed in the required position by means of a fixing device. Several balancing elements of this type are preferably used, in order to generate, for example with two balancing elements of identical mass, a counter-imbalance of any size and direction by moving said elements. The fixing device, which is for example designed in the form of a screw (grub screw) or the like, can be operated in the assembled state of the gas turbine using a tool. An access opening (horoscope opening, assembly opening or the like) is preferably used here so that additional adaptations of the engine casing are required only to a minor extent or not at all.

It is particularly advantageous when both the balancing elements and the parts used for fixing, such as screws, grub screws or the like, are designed secure against being lost. It is thus possible to perform the balancing operation without having to dismantle the engine and without running the risk of individual parts coming loose and getting into the engine.

The balancing device in accordance with the invention can thus be designed in a preferred manner without substantial changes being required to existing structural elements. The annular groove can either be provided additionally or an already existing groove, for example one employed for air tapping, can also be used.

With the embodiment in accordance with the invention, it is furthermore possible to pre-install balance weights so that they only have to be moved for trim balancing after assembly of the engine. The balancing device in accordance with the invention can thus be used repeatedly and can be adjusted at any time. This proves to be especially advantageous in particular when imbalances occur that need to be compensated during operation of the engine, for example due to wear or damage.

Figure 3:
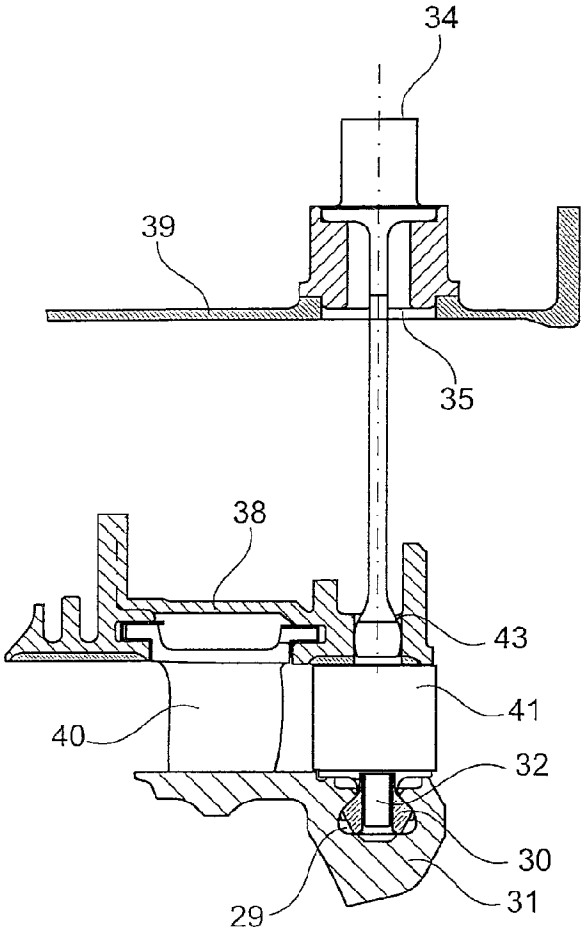
Figure 5:
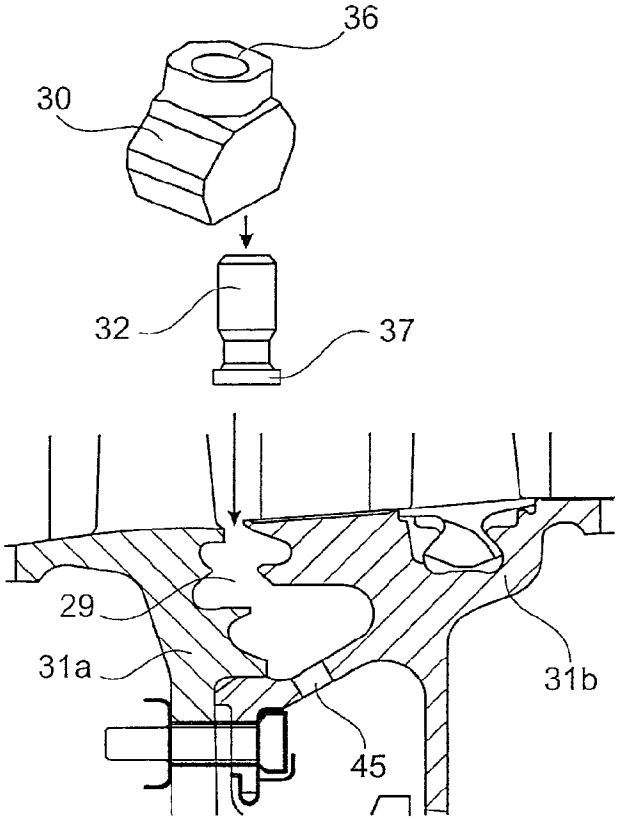
Figure 4:
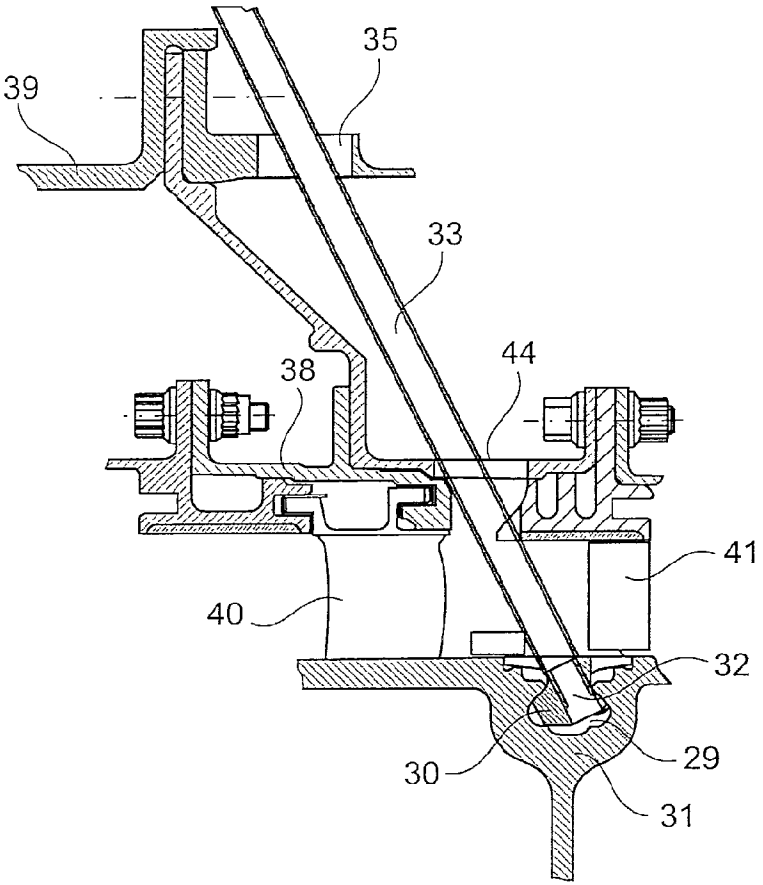

The present invention is described in the following in light of the accompanying drawings, showing exemplary embodiments. In the drawings, FIG. 1 shows a schematic representation of a gas-turbine engine in accordance with the present invention, FIG. 2 shows a schematic partial view of an exemplary embodiment in accordance with the present invention with the tool inserted, FIG. 3 shows a view, by analogy with FIG. 2, after adjustment and removal of the tool, FIG. 4 shows a further exemplary embodiment of the balancing device in accordance with the present invention, and FIG. 5 shows a detail view of a further exemplary embodiment of the present invention.

Figure 2:
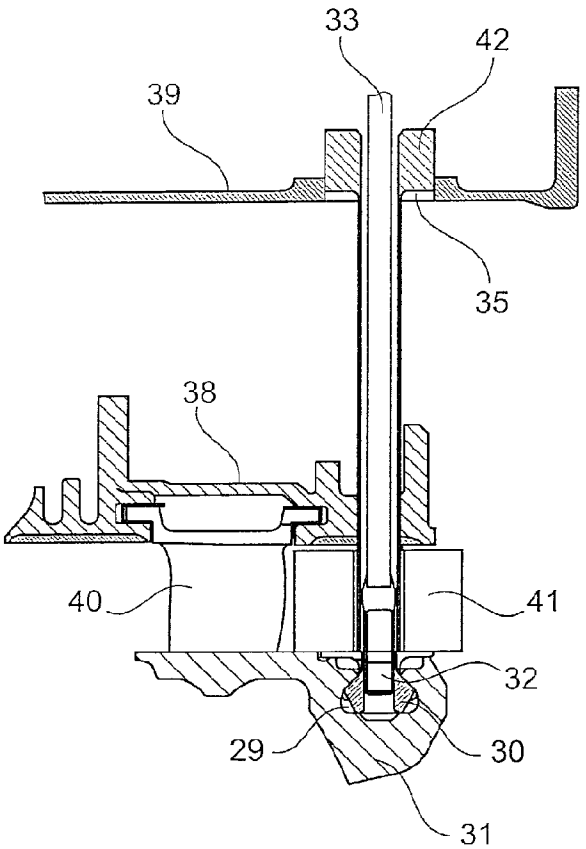

FIG. 1 shows a schematic representation of a gas-turbine engine in accordance with the present invention.

The gas-turbine engine 10 in accordance with FIG. 1 is an example of a turbomachine where the invention can be used. The following however makes clear that the invention can also be used in other turbomachines. The engine 10 is of conventional design and includes in the flow direction, one behind the other, an air inlet 11, a fan 12 rotating inside a casing, an intermediate-pressure compressor 13, a high-pressure compressor 14, combustion chambers 15, a high-pressure turbine 16, an intermediate-pressure turbine 17 and a low-pressure turbine 18 as well as an exhaust nozzle 19, all of which being arranged about a central engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of fixed stator vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

In the following exemplary embodiments, identical parts are provided with the same reference numerals.

FIGS. 2 and 3 show a first exemplary embodiment. A high-pressure rotor 31 includes a profiled annular groove 29 extending around its circumference and inside which one or more balancing elements 30 are inserted. These can be moved along the annular groove 29.

As shown in particular in connection with FIG. 5, the balancing element 30 includes a female thread 36 into which a clamping screw 32 (grub screw) is inserted. This can be provided (see FIG. 5) with a safeguard against loss, for example a base 37 having a greater diameter than the male thread of the clamping screw 32, such that the clamping screw 32 cannot be radially unscrewed to the outside.

FIGS. 2 and 3 furthermore show an inner casing 38 mounting stator vanes 40 and an outer casing 39. Rotor blades 41 are mounted on the rotor 31 in the usual way, as is known from the state of the art.

The outer casing 39 has at least one access opening 35 through which a tool 33 can be inserted. The tool 33 is for example designed in the form of a screw driver in order to turn the clamping screw 32. To guide the tool 33, an ancillary tool 42 is provided, which is inserted into the access opening 35 and mounted in an opening 43 of the inner casing 38 in order to guide the tool 33.

FIG. 3 shows a state in the balanced and assembled condition in which the tool 33 and the ancillary tool 42 have been removed. A closing element 34 is inserted to close the access opening 35 and the opening 43.

FIG. 4 shows an exemplary embodiment in which the tool 33 is inserted through a slot 44 provided in the inner casing 38 for air tapping and which can also be used.

FIG. 5 shows a further exemplary embodiment in which the annular groove 29 is provided at a joint region of two components 31*a*, 31*b* of the high-pressure rotor 31. The annular groove 29 is connected to an air-tapping opening 45, for example for turbine cooling, so that no further changes have to be made apart from the structuring of the cross-section of the annular groove 29.

The invention thus provides a groove or an annular gap inside the high-pressure rotor of a turbine engine, into which balancing elements adapted to this groove are inserted. The annular gap can in particular be combined with possibly necessary air-tapping points inside the compressor rotor (e.g. for turbine cooling), as often provided in modern compressors. These are achieved most easily by an annular gap created between two bolted parts (e.g. front and rear rotor drum).

The balancing elements include a female thread into which a grub screw is inserted to secure them and which is braced against the rotor. The screws can be prevented from falling out by a safeguard against loss or by appropriate geometry.

For trim balancing, these balancing elements (preferably two or more) are then moved in the circumferential direction or rotated to create a suitable counter-imbalance. The rotation of the balancing elements is achieved for example by holding the latter tight and rotating the rotor relative to the balancing elements.

The accessibility for holding, releasing and tightening the grub screws is assured via the casing. To guide the assembly tool, an ancillary tool can be used. After assembly of the grub screws, the ancillary tool and the tool are removed and the cavity sealed with a plug (closing element) so that the tightness of the inner and outer casings is assured.

Alternatively, it is possible in accordance with the invention to use air-tapping points inside the casing. The tool is inserted through the existing slots. The use of these air-tapping points reduces the complexity of the plug and makes it superfluous when the access in the outer casing can also be accomplished via the air-tapping points.

The position of the balancing elements used, radially far outward and preferably centered between the bearings, is advantageous for compensating the residual imbalance. Even a minor position change leads to a relatively large effect on the imbalance with a comparatively low mass of the balancing elements.

The following advantages in particular therefore result in accordance with the invention:

- compensation of the residual imbalance at the rotor at a position not accessible from the outside without ancillary tools (turbine or compressor) in the assembled state of the engine;
- compensation of imbalances after repairs to the rotor blades or similar;
- balancing in the rotor-dynamically optimum range (far outward and in the centre of the rotor) and hence with the lowest possible additional weight;
- minimization of additional components and hence low costs and low weight;
- simple implementation in existing engines by extensive use of existing or similar parts.

LIST OF REFERENCE NUMERALS

1 Engine axis
10 Gas-turbine engine
11 Air inlet
12 Fan rotating inside the casing
13 Intermediate-pressure compressor
14 High-pressure compressor
15 Combustion chambers
16 High-pressure turbine
17 Intermediate-pressure turbine
18 Low-pressure turbine
19 Exhaust nozzle
20 Guide vanes
21 Engine casing
22 Compressor rotor blades
23 Stator vanes
24 Turbine blades
26 Compressor drum or disk
27 Turbine rotor hub
28 Exhaust cone
29 Annular groove
30 Balancing element
31 High-pressure rotor
32 Clamping screw
33 Tool
34 Closing element

35 Access opening
36 Female thread
37 Base
38 Inner casing
39 Outer casing
40 Stator vane
41 Rotor blade
42 Ancillary tool
43 Opening
44 Slot
45 Air-tapping opening

What is claimed is:

1. A gas-turbine balancing device, comprising:

at least one annular groove provided on an outer circumference of at least one intermediate or high-pressure rotor of an intermediate or high-pressure compressor, at least one balancing element arranged in the annular groove, wherein the at least one balancing element is moveable in a circumferential direction along the at least one annular groove and includes a fixing device;

wherein the at least one annular groove is provided at a circumferentially extending joint region between first and second axially adjacent attached components of the at least one intermediate or high-pressure rotor and each of the first and second axially adjacent attached components assists in retaining the balancing element, wherein a first side of the at least one annular groove is formed by the first axially adjacent attached component and a second side of the at least one annular groove is formed by the second axially adjacent attached component, such that the first axially adjacent attached component engages a first side of the at least one balancing element and the second axially adjacent attached component engages a second side of the at least one balancing element to retain the at least one balancing element in the at least one annular groove.

2. The balancing device in accordance with claim 1, wherein the at least one balancing element includes a body having a threaded bore passing through the body.

3. The balancing device in accordance with claim 1, wherein the at least one intermediate or high-pressure rotor is a high-pressure rotor and the annular groove is constructed and arranged to tap air from the high-pressure rotor.

4. The balancing device in accordance with claim 1, wherein the fixing device includes at least one clamping screw aligned in a substantially radial direction to an engine axis.

5. The balancing device in accordance with claim 4, and further comprising at least one access opening for the at least one clamping screw and a closing element for closing the at least one access opening.

6. The device in accordance with claim 4, wherein the at least one clamping screw is a grub screw.

7. The balancing device in accordance with claim 1, wherein the fixing device includes a safeguard against loss.

* * * * *